US007097281B2

(12) United States Patent
Liu

(10) Patent No.: US 7,097,281 B2
(45) Date of Patent: Aug. 29, 2006

(54) INK SUPPLY APPARATUS FOR PRINTERS

(76) Inventor: Chun Yun Liu, 12F., No. 56-3, Fuhua 9th St., Jhongli City, Taoyuan County (TW) 32055

( * ) Notice: Subject to any disclaimer, the term of this patent is extended or adjusted under 35 U.S.C. 154(b) by 262 days.

(21) Appl. No.: 10/852,118

(22) Filed: May 25, 2004

(65) Prior Publication Data

US 2005/0206695 A1 Sep. 22, 2005

(30) Foreign Application Priority Data

Mar. 19, 2004 (TW) ..... 93204243 U

(51) Int. Cl.
*B41J 2/14* (2006.01)
*B41J 2/175* (2006.01)

(52) U.S. Cl. ..... 347/49; 347/50; 347/85

(58) Field of Classification Search ..... 347/7, 347/49, 50, 58, 85, 86, 87; 439/151, 247
See application file for complete search history.

(56) References Cited

U.S. PATENT DOCUMENTS 5,138,342 A * 8/1992 Kurata et al. ..... 347/50
5,408,746 A * 4/1995 Thoman et al. ..... 29/890.1
5,886,721 A * 3/1999 Fujii et al. ..... 347/87
6,164,771 A * 12/2000 Eckard et al. ..... 347/86
6,170,937 B1 * 1/2001 Childers et al. ..... 347/85
6,196,736 B1 * 3/2001 Otsuki et al. ..... 400/124.01
6,302,535 B1 * 10/2001 Sturgeon et al. ..... 347/86
6,551,148 B1 * 4/2003 Sturgeon et al. ..... 439/862
6,676,426 B1 * 1/2004 Sturgeon et al. ..... 439/247

* cited by examiner

*Primary Examiner*—Anh T. N. Vo
(74) *Attorney, Agent, or Firm*—Harness, Dickey & Pierce, P.L.C.

(57) ABSTRACT

An ink supply apparatus for printers is installed on an ink cartridge housing compartment of a printer and includes a liquid storing cartridge which has an ink channeling chamber and a buffer chamber that communicate with each other. The ink channeling chamber has an ink inlet corresponding to an ink intake aperture formed in the ink cartridge housing compartment. An ink storing unit is provided to hold the ink which can flow to the liquid storing cartridge through a duct. The ink cartridge housing compartment further has a chip dock which holds control chips corresponding to signal receiving sections of the printer. A bucking member is provided to press the chip dock so that the control chips may form a tight coupling with the signal receiving sections.

7 Claims, 4 Drawing Sheets

INK SUPPLY APPARATUS FOR PRINTERS

FIELD OF THE INVENTION

The present invention relates to an ink supply apparatus for printers adopted for use on inkjet printers and particularly to a low cost and easy to install ink supply apparatus for printers.

BACKGROUND OF THE INVENTION

Inkjet printers are widely used in offices, houses and by individuals nowadays. With increasing awareness of environmental protection, more and more products are designed with recycling and a reusable concept. As the ink cartridge of inkjet printers is a consumption material, besides to improve the printing quality, vendors also try to explore the possibility of recycling the ink cartridge. This has become one of the focuses of product design these days.

There are three types of the ink-refilling apparatus. The first one has an external injection tube to inject ink into the cartridge. The cartridge has an ink-storing chamber, ink-supply chamber and ink-channeling element to perform an ink-refilling operation.

The second one has a coupling trough on one side of the ink cartridge to enable a chip to be movably wedged therein. The third one includes a positioning unit, duct and ink storing unit. The positioning unit includes an anchor seat fixedly located on the printer case and a detachable coupling member to form a duct anchoring mechanism in the printer.

While the cited references can function reasonably well to achieve some specific effects, there are still rooms for improvement. For instance, the first type of the ink-refilling apparatus is the most commonly used ink replenishment technique at present. It has to inject ink into the ink storing chamber of the ink cartridge through the injection tube, then a tubular ink channeling element is used to channel the ink to the ink supply chamber of the ink cartridge. Its structure is complicated. Fabrication is difficult and cost is higher. The second one has an ink cartridge with a movable chip that allows the chip to be recycled and used repeatedly. While the chip may be reclaimed, the ink cartridge has to be discarded after the ink has been consumed. Hence the environmental pollution problem because of the discarded ink cartridge still remains unresolved. In the continuous ink supply apparatus proposed by the third one, users have to send the printers to the printer manufacturers for modification to install the positioning unit on the rear side of the printer. A duct has to be connected to the ink-storing unit when in use. This method of relying on the manufacturers for installation is not convenient to users. Moreover, such a design is targeted to selected types of printers. For used elements, installation locations and dimensions have to be designed to match the interior space of the selected printers. Hence this is not applicable to other types of printers.

All this shows that the conventional techniques or products now on the market still have problems to be solved.

SUMMARY OF THE INVENTION

Therefore the primary object of the invention is to provide a low cost and easy to install ink supply apparatus for printers.

The ink supply apparatus according to the invention includes a liquid storing cartridge, a chip dock and a bucking member located in an ink cartridge-housing compartment of a printer. The liquid storing cartridge has an ink-channeling chamber and a buffer chamber that communicate with each other. The ink-channeling chamber has ink inlets corresponding to ink intake apertures of the printer. The buffer chamber has an ink replenishing opening on the top end. There is a hollow ink-storing unit for holding ink of a selected color. It is linked to one end of a duct which has another end running through the ink replenishing opening and the buffer chamber so that ink in the ink storing unit may be channeled by the duct to fill the liquid storing cartridge and supply required ink for printing operation of the printer. The chip dock has a plurality of wedge troughs to hold control chips. The wedge troughs are formed according to signal receiving sections of the printer. The bucking member has two ends pressing respectively one side of the ink cartridge housing compartment and one side of the chip dock, so that the control chips on the chip dock form a close coupling with the signal receiving sections.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
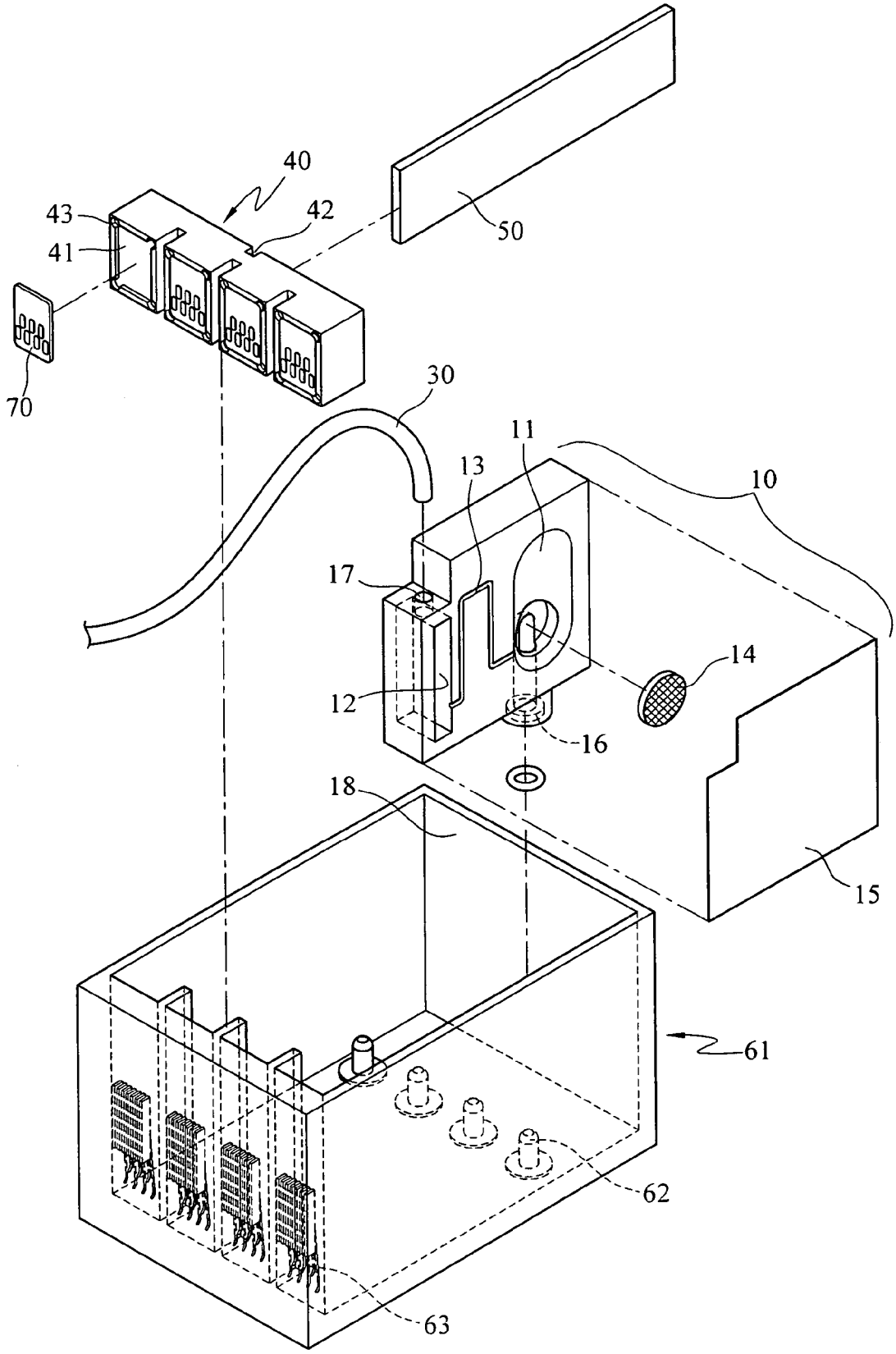
FIG. 1 is an exploded view of the ink supply apparatus for printers of the invention.

Referring to FIG. 1, the ink supply apparatus according to the invention includes a liquid storing cartridge 10, an ink storing unit 20, a duct 30, a chip dock 40 and a bucking member 50 substantially formed in an elongated plank. The liquid storing cartridge 10, chip dock 40 and bucking member 50 are housed in an ink cartridge housing compartment 61 located in a printer 60 (referring to FIG. 3). The ink cartridge housing compartment 61 has a plurality of signal receiving sections 63 and a plurality of ink intake apertures 62 to receive ink supplied by the liquid storing cartridge 10. The signal receiving sections 63 aim to read data of control chips 70. The chip dock 40 has a plurality of wedge troughs 41 on one side and a plurality of cavities 43 adjacent to the wedge troughs 41 for holding the control chips 70. The chip dock 40 has a retaining trough 42 on another side.

Figure 2:
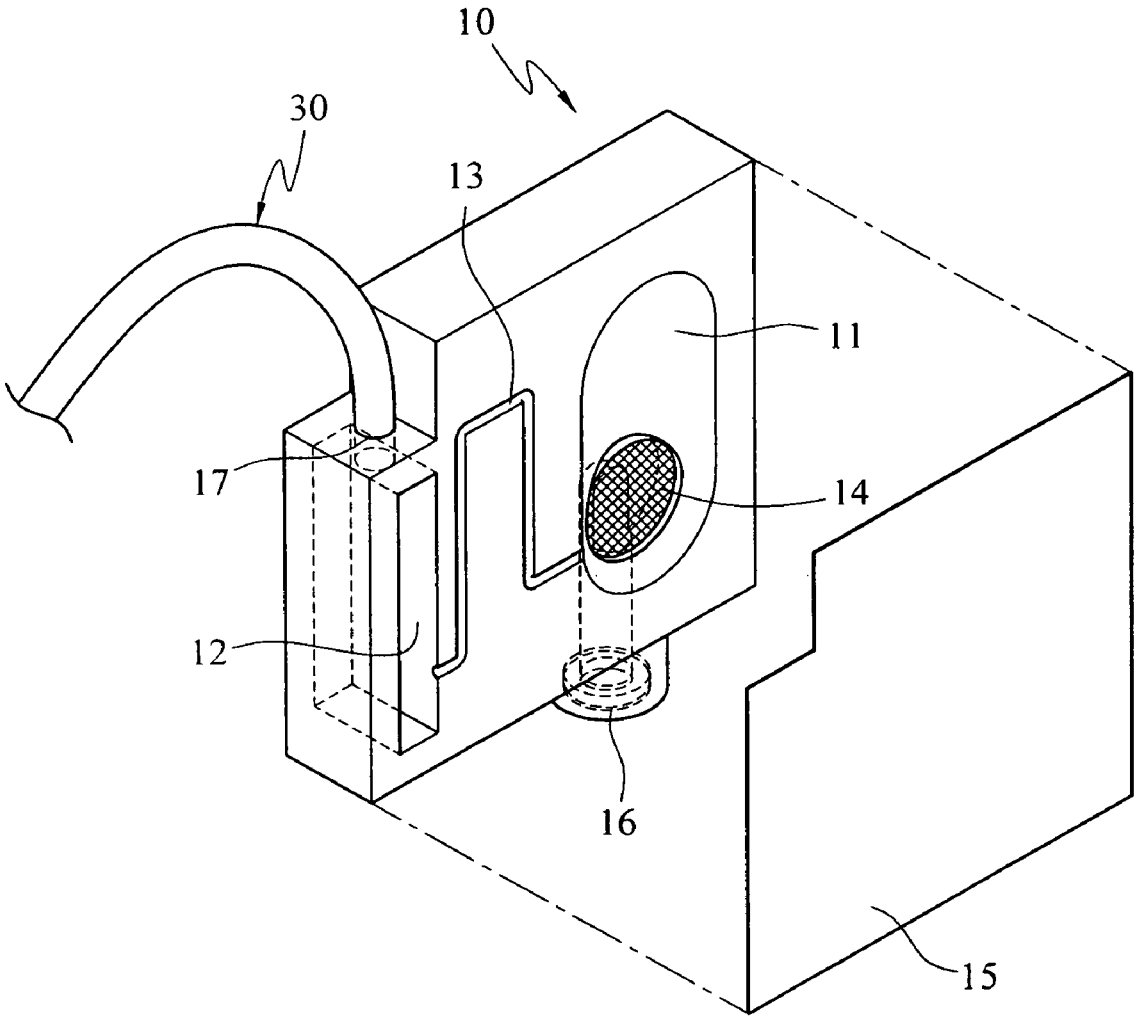
FIG. 2 is a schematic view of the liquid storing cartridge of the invention.

Referring to FIG. 2, the liquid storing cartridge 10 is located on where the ink intake aperture 62 of the ink cartridge housing chamber 61 is formed and has an ink channeling chamber 11 and a buffer chamber 12 that communicate with each other through a fine tube 13. The ink-channeling chamber 11 has an ink inlet 16 on the bottom corresponding to the ink intake aperture 62 so that the ink stored in the ink-channeling chamber 11 can flow through the ink inlet 16 and the ink intake aperture 62 to the printer 60 for printing operation. The ink-channeling chamber 11 further has an elastic membrane 15 on one side to maintain a selected negative pressure in the ink-channeling chamber 11 in normal condition, to prevent the ink from flowing out. In addition, there is a filter 14 located between the ink-channeling chamber 11 and the ink intake aperture 16, to filter out impurities from the ink. The buffer chamber 12 has an ink replenishing opening 17 on the top side communicating with the ink storing unit 20 through the duct 30. Namely, the ink contained in the ink-storing unit 20 is channeled by the duct 30 to fill the liquid storing cartridge 10. Elaborated in more details, the ink in the ink storing unit 20 flows to the buffer chamber 12 through the duct 30, and fills the ink channeling chamber 11 through the fine tube 13.

Figure 3:
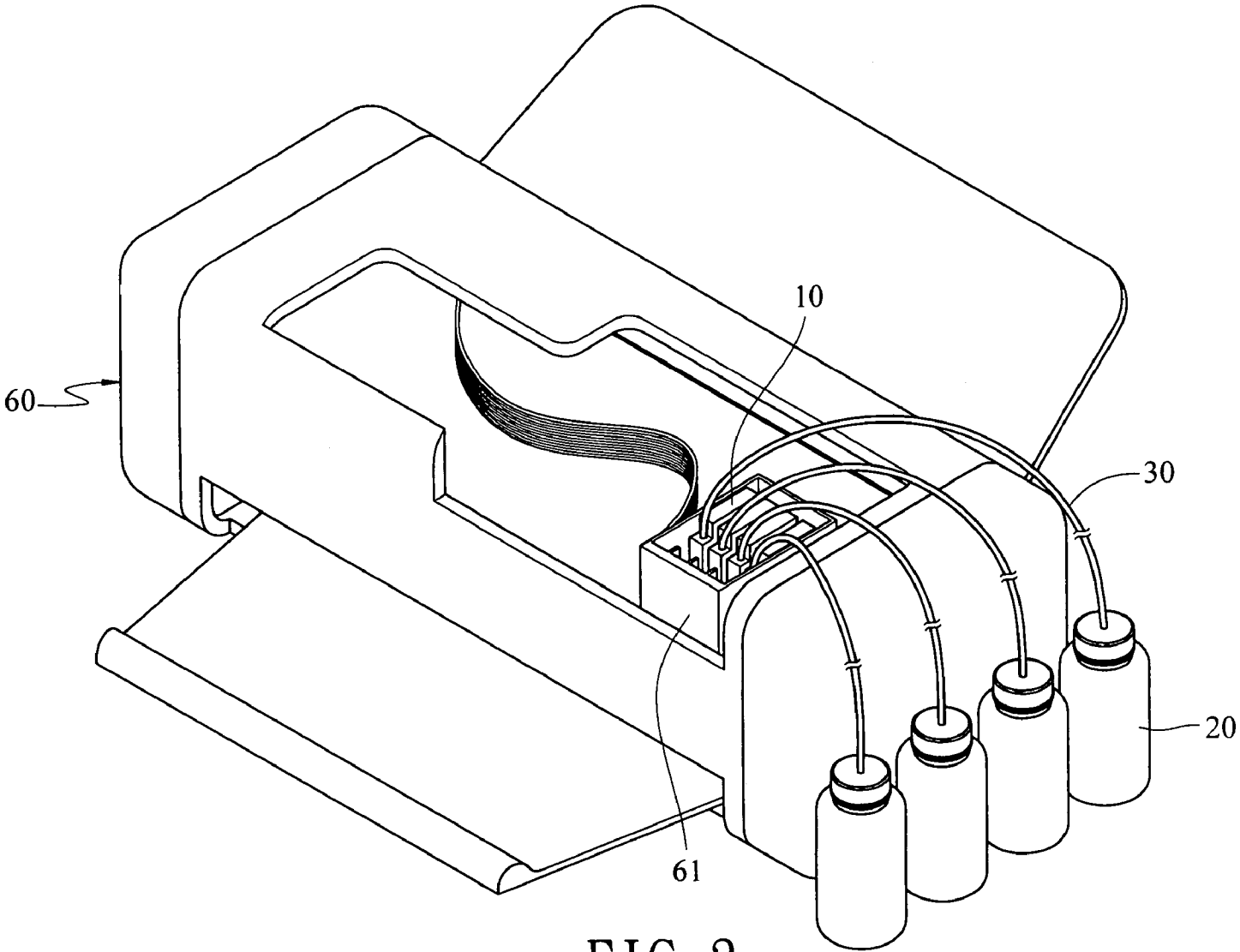
FIG. 3 is a schematic view of the ink supply apparatus of the invention in an assembled condition.
Figure 4:
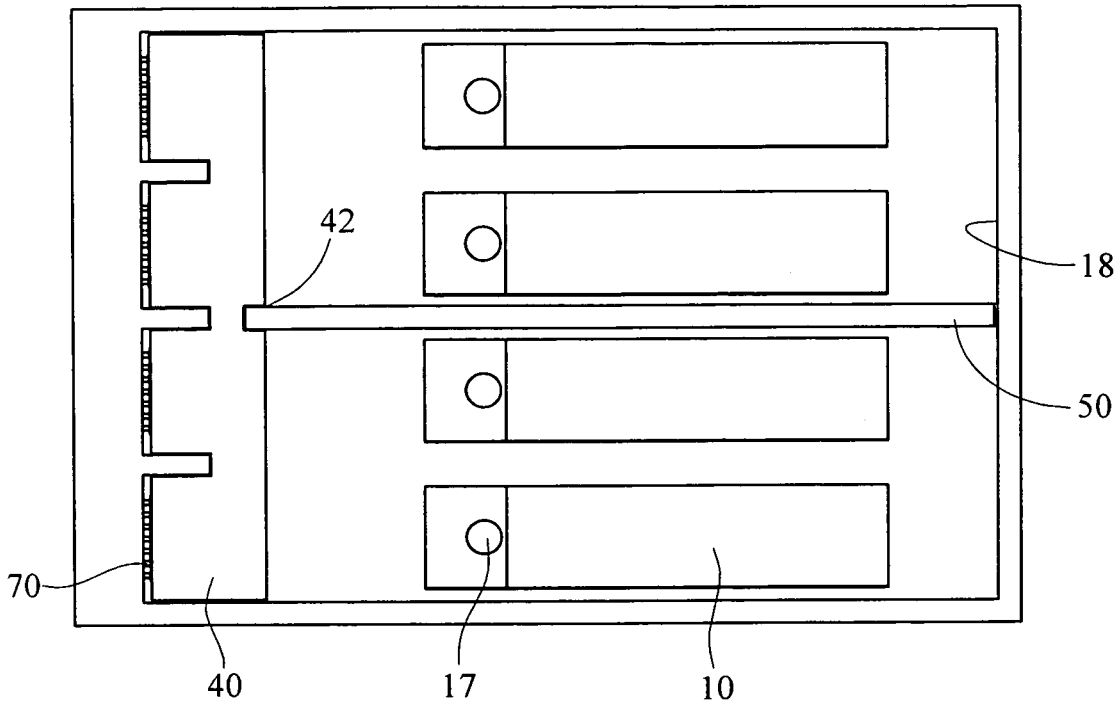
FIG. 4 is a top view of the ink supply apparatus of the invention.

Referring to FIGS. 3 and 4, for assembly, first, place the liquid storing cartridge 10 in the ink cartridge housing compartment 61 and couple the ink inlet 16(FIG. 1) with the corresponding and mating ink intake aperture 62(FIG. 1) to establish communication between the two; replenish the ink in the liquid storing cartridge 10 from the ink storing unit 20 through the duct 30; install the chip dock 40 on the corresponding signal receiving sections 63 of the ink cartridge housing compartment 61; place one end of the bucking member 50 to press a side wall 18 of the ink cartridge housing compartment 61 and another end to wedge in the retaining trough 42 of the chip dock 40 so that the chip dock 40 is pressed by the bucking member 50, to allow the control chips 70 located in the wedge troughs 41 to be coupled tightly with the signal receiving sections 63, to complete the assembly and installation.

By means of the construction set forth above, the invention can achieve at least the following advantages:

1. Users can do assemble and install by themselves: The liquid storing cartridge 10 and the chip dock 40 are installed on the rear side of the ink cartridge housing compartment 61, and the chip dock 40 is in close contact with the signal receiving sections 63 due to the bucking member 50; two ends of the duct are connected to the ink storing unit 20 and the liquid storing cartridge 10. All this can be assembled and installed by users without modifications of the vendors. Assemblage and installation are simple.

2. The elements are reusable repeatedly: When the ink held in the ink storing unit 20 is consumed and exhausted, it can be replenished. All other elements also are reusable. Thus the environmental pollution problem can be eliminated.

3. Lower costs: The elements of the invention are simply structured. Production costs may be reduced and result in greater competitiveness of the product on the market.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments, which do not depart from the spirit and scope of the invention.

What is claimed is:

1. An ink supply apparatus for printers adopted for use on a printer which has an ink cartridge housing compartment that includes at least one ink intake aperture and at least one signal receiving section, comprising:

at least one liquid storing cartridge located in the ink cartridge housing compartment including an ink channeling chamber and a buffer chamber, the ink channeling chamber having an ink inlet corresponding to the ink intake aperture, the buffer chamber having an ink replenishing opening;

at least one ink storing unit containing ink of a selected color;

at least one duct having one end communicating with the ink storing unit and other end running through the ink replenishing opening and the buffer chamber to allow the ink held in the ink storing unit to fill the liquid storing cartridge through the duct;

a chip dock located in the ink cartridge housing compartment having at least one wedge trough on one side corresponding to the signal receiving section to hold an external control chip; and a bucking member having two ends to press respectively one side of the ink cartridge housing compartment and another side of the chip dock opposite to the wedge trough so that the chip dock is pressed by the bucking member to allow the control chip to form a tight coupling with the signal receiving section.

2. The ink supply apparatus for printers of claim 1, wherein the ink channeling chamber communicates with the buffer chamber through a fine tube.

3. The ink supply apparatus for printers of claim 1, wherein the ink channeling chamber has a filter to filter out impurities in the ink.

4. The ink supply apparatus for printers of claim 1 further having a cavity adjacent to the wedge trough for installing the control chip.

5. The ink supply apparatus for printers of claim 1, wherein the chip dock has a retaining trough located on the another side to couple with the bucking member to wedge the bucking member.

6. The ink supply apparatus for printers of claim 1, wherein the bucking member is substantially an elongated plank.

7. The ink supply apparatus for printers of claim 1, wherein the ink channeling chamber includes an elastic membrane.

* * * * *